US005499042A

United States Patent [19]

Yanagawa

[11] Patent Number: 5,499,042

[45] Date of Patent: Mar. 12, 1996

[54] INK JET HEAD HAVING DUMMY PRESSURE CHAMBERS AND INCLINED GROUPS OF EJECTION NOZZLES

[75] Inventor: Yoshihiko Yanagawa, Tokyo, Japan

[73] Assignee: Citizens Watch Co. Ltd., Tokyo, Japan

[21] Appl. No.: 266,298

[22] Filed: Jun. 27, 1994

Related U.S. Application Data

[63] Continuation of Ser. No. 11,769, Feb. 1, 1993, abandoned.

[30] Foreign Application Priority Data

Jan. 31, 1992 [JP] Japan ..... 4-040621

[51] Int. Cl.[6] ..... B41J 2/045; B41J 2/055

[52] U.S. Cl. ..... 347/69; 347/12; 347/40; 347/94

[58] Field of Search ..... 347/12, 13, 40, 347/68, 69, 94

[56] References Cited

U.S. PATENT DOCUMENTS 5,359,354 10/1994 Hiraishi et al. ..... 347/69

FOREIGN PATENT DOCUMENTS 61-263760 10/1986 Japan .

*Primary Examiner*—Benjamin R. Fuller
*Assistant Examiner*—Alrick Bobb
*Attorney, Agent, or Firm*—Wenderoth, Lind & Ponack

[57] ABSTRACT

In a piezoelectric type ink jet head, a plurality of pressure chambers are separated into n groups each having dummy pressure chambers at opposite ends. An increased spacing between ejection nozzles resulting from the dummy pressure chambers is compensated for by inclining the nozzle openings within each of the groups. The ink jet head is driven in a time sharing manner.

6 Claims, 13 Drawing Sheets

INK JET HEAD HAVING DUMMY PRESSURE CHAMBERS AND INCLINED GROUPS OF EJECTION NOZZLES

This application is a Continuation of now abandoned application, Ser. No. 08/011,769, filed Feb. 1, 1993 now abandoned.

BACKGROUND OF THE INVENTION

1. Field of the Invention

The present invention relates to a printer, and more particularly, to a piezoelectric type ink jet head which employs shearing force mode and a method for driving the same.

2. Description of the Prior Art

For example, Japanese Laid-Open Patent Publication No. 18054/1990 discloses a drive technique of a printing head by means of a shearing force mode which includes deforming a barrier of a channel-like pressure chamber by using a deformation caused by a shearing force of a piezoelectric element and projecting an ink caused by the resultant pressure elevation of the pressure chamber.

Japanese Laid-Open Patent Publication No. 263760/1986 discloses an on-demand type printing head which includes mounting an electro-deforming element on an upper plate of an ink chamber, deforming the upper surface of the ink chamber by a stretching action of the electro-deforming element and projecting an ink.

In the conventional driving circuit for a printing head by deforming a barrier of a pressure chamber using a shearing force mode of a piezoelectric element as described in Japanese Laid-Open Patent Publication No. 18054/1990, drivers are required for each of corresponding driving electrodes provided for a plurality of channels which form an ink injection pressure chamber, and thus suffers drawbacks such as an increase in cost and an increase in space of the driving circuit, although the head itself has an advantage in that it is suitable for decreasing costs when compared with other modes. If a time-sharing drive mode which is disclosed in Japanese Laid-Open Patent Publication No. 263760/1986 is adopted so as to overcome the above-described defects, the structure of the head becomes a serial circuit of capacitators 703 as shown in FIG. 10(*b*) when pressure chambers of channels 701 have injection holes 702 as shown in FIG. 10(*a*). The equivalent circuit of a plurality of piezoelectric elements which forms the other type piezoelectric ink injection head becomes a parallel circuit of capacitators 901 having two terminals as shown in FIG. 12 and, if one side of each of the electrodes is connected to each of group drivers 911, 912, 913 as a common electrode of each group and the other side of each electrode is connected to each of channel drivers 921,922, and 923, each of which corresponds to the arrangement order in each group, and a group selection signal is added to a signal-input terminal of each group driver and a printing signal of the group is added to a signal-input terminal of each channel driver, ink injection operations corresponding to each printing signal of the each groups can be sequentially driven in a time-sharing manner in which the group number is n. To render time-sharing drive as described above, it is necessary to reconcile commonness and independence of electrodes group by group. However, if electrodes are connected with each other and are made common in a serial circuit of capacitors shown in FIG. 10(*b*), each independent drive becomes impossible and time-sharing drive becomes difficult. Thus, in this case, the drivers 705 are required which correspond to the number of driving electrodes 704. In a case of using a shearing force mode, a technique is also known which comprises alternatively arranging a channel J having an injection hole and a dummy channel D without having an injection hole as shown in FIG. 11(*a*). The equivalent cuircuit is made to a serial circuit of capacitators 803 as shown in FIG. 11(*b*) and is made to a common electrode by connecting a dummy electrode 804 and thus it can be independently driven in each driving electrode. But, if the common dummy electrode is sheared in any portion, a loop of charging and discharging between the dummy electrode and its adjacent driving electrode 802 is cut off and the barrier 803 of this part is made impossible to drive and thus time-sharing drive is made impossible. In addition, the conventional time-sharing drive mode has a defect in that printing dot pitch in a vertical direction is made ununiform due to the unevenness of the distances between adjacent injection holes which correspond to a phase difference of timings of injection from the injection holes, each of which belongs to different groups.

SUMMARY OF THE INVENTION

It is, accordingly, an object of the present invention to make it possible to perform a time-sharing drive of a printing head in which a pressure chamber is deformed using a shearing force mode of a piezoelectric element and realize an inexpensive ink jet printer system and remove an unevenness of printing dot pitch which is accompanied with the time-sharing drive and improve printing quality.

In accordance with the present invention, the above object is achieved by an ink jet head which is provided on a printing head which has a board made of a piezoelectric material comprising a plurality of channels which form a pressure chamber and its barriers and a common channel which communicates the plurality of channels and supplies an ink and which is made by mounting a nozzle plate having injection holes which inject the ink to an end surface where the plurality of channels of the board are opened and mounting an electrode for a piezoelectric drive to the plurality of channels, and which inject the ink charged in the pressure chamber from the injection holes by applying a driving electric voltage to deform the barriers with a shearing force mode and change a capacity of the pressure chamber and, characterized by (A) providing a dummy channel which does not inject the ink adjacent to the injection channel which injects the ink, collecting a series of channels including m pieces of the injection channels which continue via the dummy channels to make a group, arranging the dummy channel at both ends of each group, separating the whole channel sequence into n groups by making the barrier between the two continuous dummy channels a separating barrier and connecting with each other dummy electrodes in the each group and separating the dummy electrodes between the different groups with the separating barrier to make a common electrode;

(B) inclining a center line of an arrangement of the injection holes in the group by angle θ° with respect to the horizontal direction of printing dots in the group such that the vertical component of a distance between adjacent injection holes is represented by p and the horizontal component thereof is represented by kp which is a whole number of p; and, (C) parallelly translating the center line of the arrangement of the injection holes of the preceding groups to the extent of a length represented by (g+1/n)p by using an integer g in the direction reverse to the proceeding direction of the printing head between the groups such that any dot pitches of the vertical and horizontal directions of the printing possess a uniform value p to make an arranged center line of the injection holes of the succeeding groups and making an arrangement that the first injection hole of the succeeding group is placed at the position on the arranged center line where the horizontal component of the distance between the first injection hole of the succeeding group and the last injection hole of the proceeding group, and, optionally, inclining the arranged direction of the channels Φ° with respect to the horizontal direction of printing.

The present invention also provides a method of driving the ink jet head characterized by connecting a group driver, each corresponding to a common electrode made by connecting each dummy electrode in a group where channel arrangements of the ink jet head are the same, connecting injection channel electrodes having the similarly arranged order to a common channel driver in each group and successively driving an ink injection movement corresponding to printing signals in each group with n time-sharing.

According to the present invention, both sides electrodes of the separating barrier are made to dummy electrodes and the polarity of each electrode can be independently selected, since it is made to one group a series of channel sequence having a dummy channel which does not inject an ink on both sides of the channel arrangement which forms a pressure chamber of an ink jet head and has a structure that n groups of the channel sequence are connected with each other via a separating barrier. Furthermore, the separating barrier is free from an ink injection and thus it is not necessary to drive the separating barrier by conducting charging and discharging. Accordingly, the different groups can be driven in an electrically separated state to permit a time-sharing drive.

The above channel arrangement has an inclination to widen the distance of the injection channels between the groups and significantly shift it from an equivalent pitch, since two dummy channels are continuously present between the groups. Thus, the present invention has a feature of injection hole arrangement which compensates such defects caused by time-sharing and makes it possible to do dot printing which has the same distance. Namely, the above-described arrangement structure of injection holes obviates a defect that the pitch of injection channels is increased in an intra-group compared with an inter-group and an influence of changing of dot pitches caused by phase difference of time-sharing timing between the intra-groups to arrange the longitudinal direction of printing dot vertical and make the pitchs of printing dot in the horizontal and vertical directions uniform. Furthermore, if necessary, by inclining the channel arrangement direction to the end surface of an substrate angle Φ° which is different from the angle θ° with respect to the horizontal direction, the distance between the injection holes and the channel center can be suppressed in a given range even when the sharing number n is increased.

The channel arrangement which forms a pressure chamber of a printing head of the present invention make a series of channel sequence having a dummy channel which does not inject an ink on its both sides to one group and has a structure that n groups are connected with each other via a separating barrier and, thereby, both side electrodes of the separating barrier are made to dummy electrode and the polarity of each electrode can be independently selected. Accordingly, by connecting a plurality of channel electrodes in a group with each other to make a common electrode in each group in the state separated from the other groups by means of the separating barrier, connecting each group driver to the common electrode, connecting each channel electrode having the same arrangement orders in each group to each channel driver, adding a selection signal to each group driver in respectively different phases and adding a selective printing signal to the channel drivers in each group, ink injection operations can be successively driven with n time-sharing. As a result, a driving circuit which has been required nm pieces of drivers requires only (n+m) pieces of drivers, which permits a decrease in cost in the production of the driving circuit and a decrease in the volume of the driving circuit produced.

BRIEF DESCRIPTION OF THE DRAWINGS

FIG. 8(*b*) is a side view illustrating a structure according to the third embodiment of the present invention;

FIG. 10(*b*) is a block diagram illustrating a driving circuit of the prior art;

FIG. 11((*b*) is a view illustrating an equivalent circuit of the prior art;

DESCRIPTION OF THE PREFERRED EMBODIMENT

Figure 1:
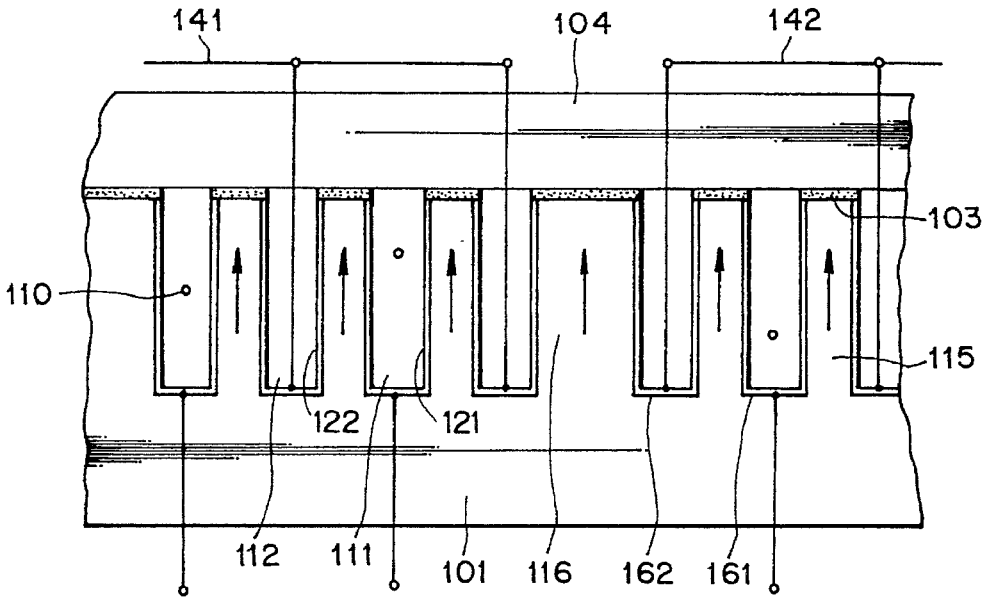
FIG. 1 is a cross-sectional view of a channel illustrating a structure according to the first embodiment of the present invention.

The preferred embodiments of the invention will now be described by way of examples with reference to the accompanying drawings, wherein like reference characters designate like or corresponding parts throughout the several views.

Figure 2:
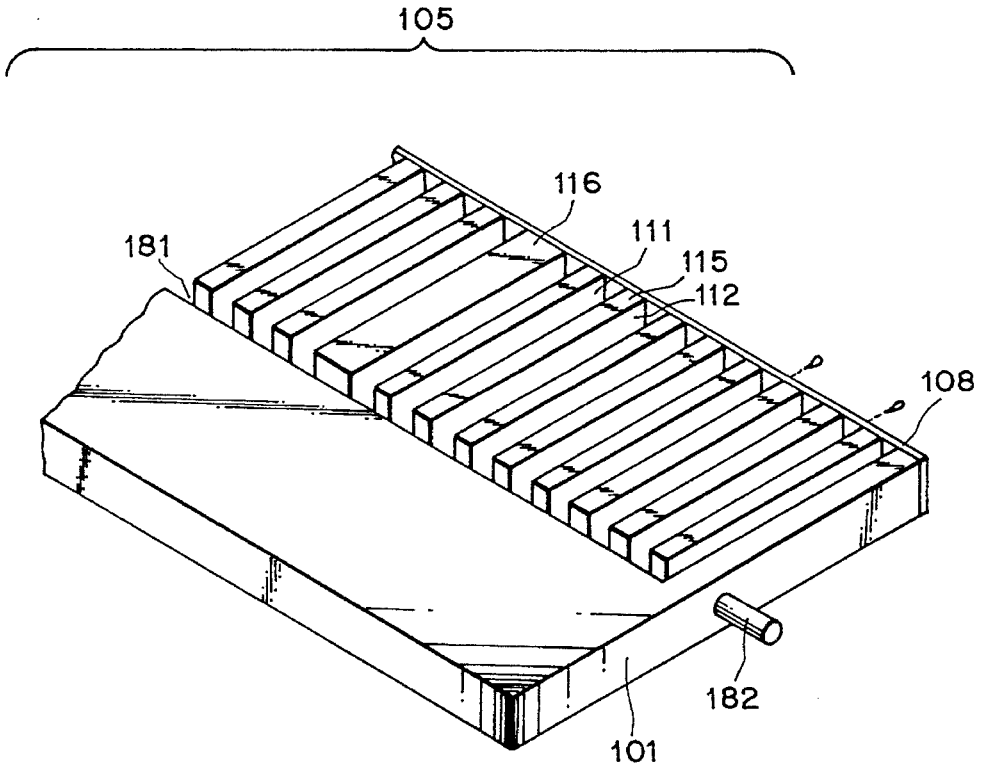
FIG. 2 is a perspective view illustrating a structure according to the first embodiment of the present invention.
Figure 3:
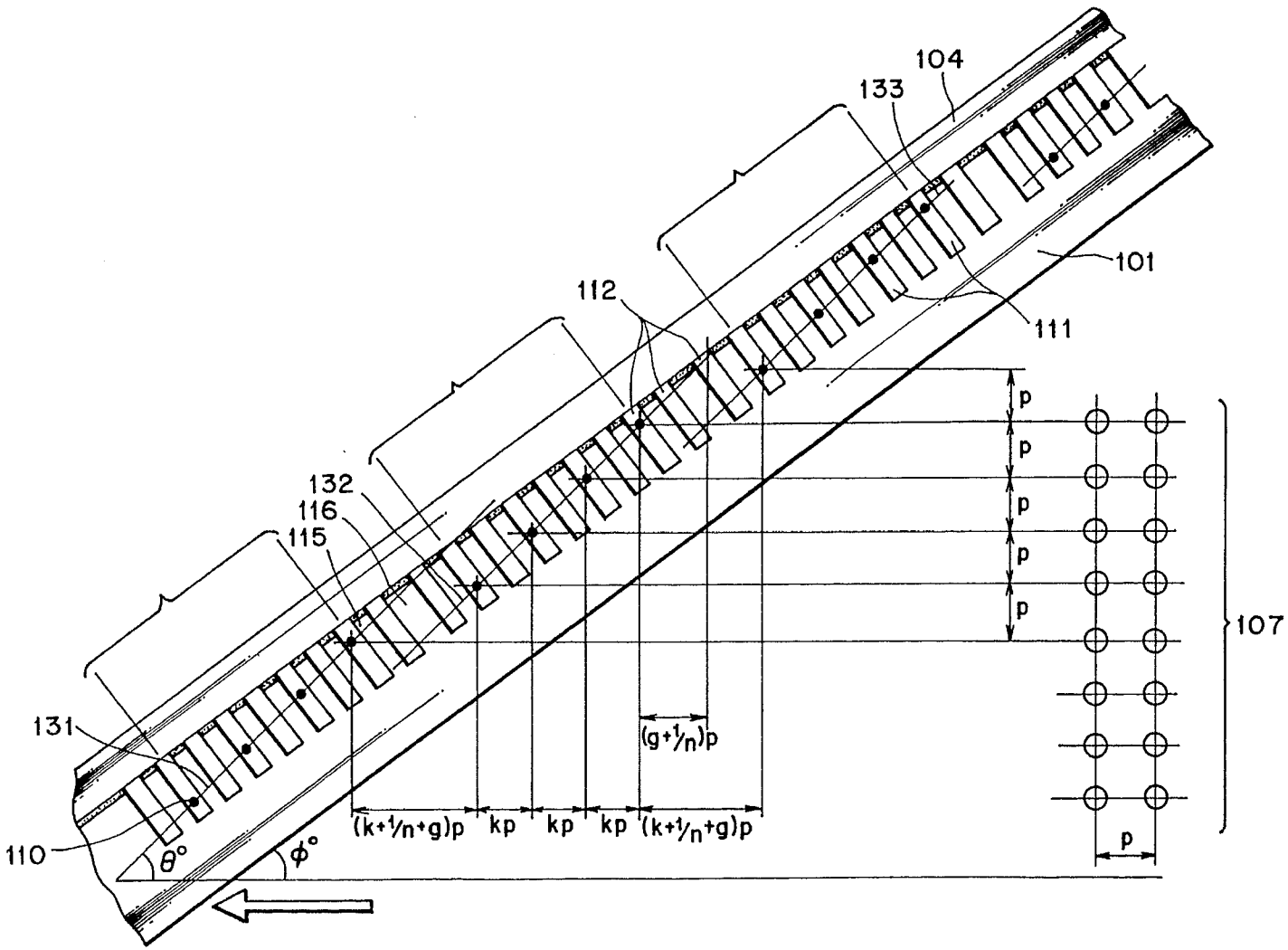
FIG. 3 is a side view illustrating an arrangement of injection holes according to the first embodiment of the present invention.

The first embodiment of the present invention directed to a printing head which operates in a mode of deforming a barrier of a pressure chamber using a deformation caused by a shearing force of a piezoelectric element. Referring to FIGS. 1–4, a plurality of barriers including driving barriers 115 which drive a plurality of channels including an injection channel 111 which injects an ink from an injection hole 110 and a dummy channel 112 which does not inject an ink and a separating barrier for electrical separation are provided on a substrate 101 made of a piezoelectric material and the upper end surfaces of these barriers are bonded to a cover 104 via an elastic member 103. The barriers 115 and 116 are polarized in a direction which is shown by an arrow in FIG. 1. A driving electrode 121 and a dummy electrode 122 are provided on the inner surfaces of the injection channel 111 and the dummy channel 112, respectively. A common channel 181 is formed so as to supply an ink by coupling to one end of the plurality of channels as shown in FIG. 2 and is communicated with a joint to supply an ink to the plurality of channels from the outside. The other end of the plurality of channels 111 and 112 are opened at an end surface of the substrate 1 and thereto is mounted a nozzle plate 108 so as to close the opening portion. As shown in FIGS. 1 and 3, the channels are arranged in such a manner that a dummy channel 112 is interposed between injection channels 111 and a series of channels, including m pieces of injection channels, are set up to form one group in which dummy channels are placed at both ends of each group, and the entire channel sequence is divided into n group which are separated by separating barriers 116. Dummy channel electrodes 122 are connected with each other in each group in a separated state by means of the separating barrier 116 to form common electrodes 141 and 142. On the nozzle plate 108, there is provided an injection hole 100 corresponding to the injection channel 111. A printing head 105 injects an ink droplet through the injection hole while moving in a direction shown by an arrow to print printing dots 107 on a paper. The injection holes are arranged in such a manner that the center lines 131, 132 and 133 of the arrangement of the injection holes in each group are inclined at angle 74° with respect to the horizontal direction so that the vertical component of the distance between the injection holes is represented by p and-the horizontal component thereof is represented by kp which is a whole number of p and, between the continuous groups, the center line of the injection hole arrangement of the preceding group is parallelly translated into the length represented by (g+1/n)p by using an integer g in the direction reverse to the proceeding direction of the printing head to make an arranged center lines of the injection holes of the succeeding group such that dot pitches in the vertical and horizontal directions of printing possess a unique value p in any place and, on the arranged center line, the first injection hole of the succeeding group is placed at the position where the vertical component of the distance between the first injection hole of the succeeding group and the last injection hole of the preceding group amounts to p. The arranged direction of the channel at an end surface of the substrate is inclined to the extent of angle $\Phi°$ which is different from the angle $\theta°$ with respect to the horizontal direction and thus it is capable of suppressing the distance between the injection holes and the channel center in a given range even when the sharing number n is increased.

Figure 5:
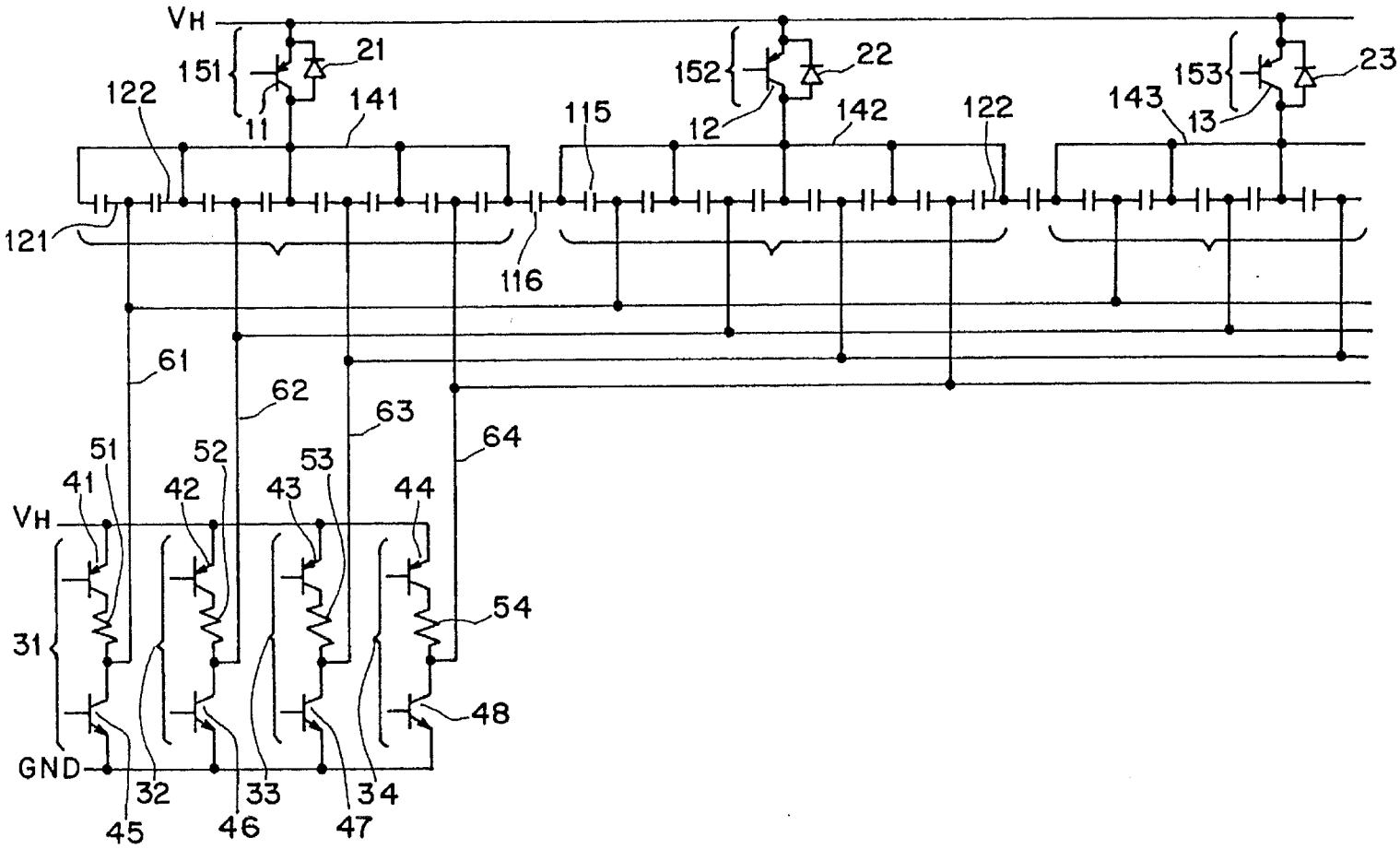
FIG. 5 is a view illustrating a circuit used for a driving method according to the first embodiment of the present invention.

Referring now to FIG. 5, an driving method of the abovedescribed printing head will be explained. Dummy electrodes 122 are connected with each other in one group to form common electrodes 141, 142 and 143 and the common electrodes are connected to a positive electric source via corresponding group drivers 151, 152 and 153, in a group by group. Each group driver comprises pnp bipolar transistors 11, 12 and 13, and diodes, each of which is parallelly connected between the collector and the emitter of the bipolar transistor with reverse in a conductive direction and the emitter is connected to a positive electric source and the collector is connected to a common electrode of its corresponding group, respectively. In each group, the first electrode of the injection hole 111 is connected to the first channel driver 31, the second electrode is connected to the second channel driver 32, the third electrode is connected to the third channel driver 33, and the fourth electrode is connected to the fourth channel driver 34, respectively. Each channel drivers 31, 32 and 33 are formed by connecting pnp bipolar transistors 41, 42, 43 and 44, resistors 51, 52, 53 and 54 and npn bipolar transistors 45, 46, 47 and 48 in series, respectively and the emitters of pnp bipolar transistors are connected to a positive electric source and the collectors of the pnp bipolar transistors are connected to the collectors of the npn bipolar transistors via the resistors, respectively. To each collector of the npn bipolar transistors 45, 46, 47 and 48, lead wires which are conducted to the corresponding electrodes are connected in addition to the resistors, respectvely and the emitters of the npn bipolar transistors are connected to to an earth wire of the electric source.

Figure 4:
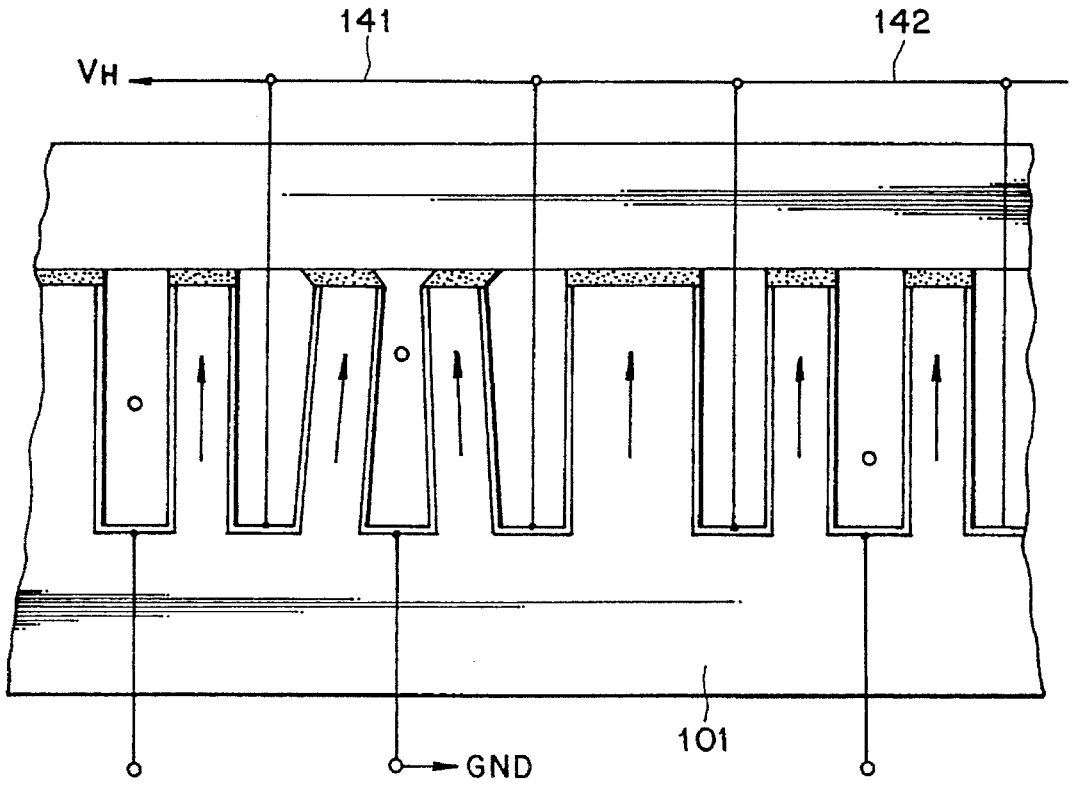
FIG. 4 is a cross-sectional view of a channel illustrating an operation according to the first embodiment of the present invention.
Figure 6:
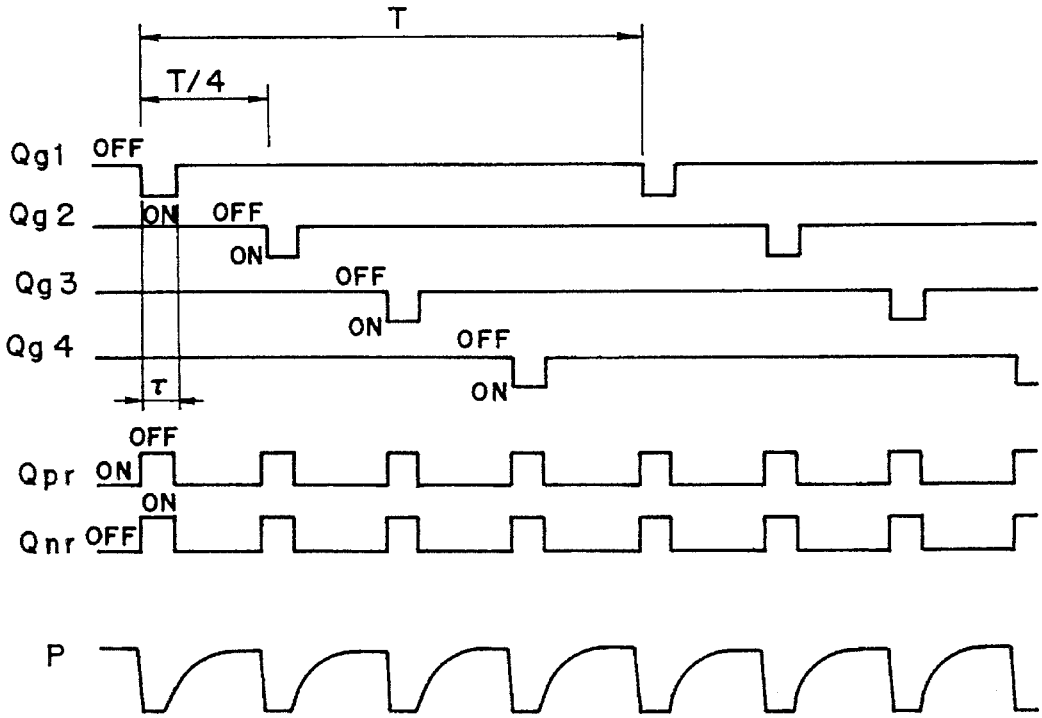
FIG. 6 is a time chart illustrating a driving method according to the first embodiment of the present invention.

Referring to a time chart of FIG. 6, the pnp bipolar transistors 11, 12 and 13 are successively made conductive for a period $\tau$ by successsively adding group selection signal Qg1, Qg2, Qg3 and Qg4 which fall in a pulse width $\tau$ and a period of T to the bases of pnp bipolar transistors 11, 12 and 13 of the first, the second, the third and the fourth group drivers of FIG. 5. with a phase deviation (1/T) and are made conductive for the other period. By adding channel selection signals Qpr and Qnr which rise up with a pulse width $\tau$ simultaneous and synchronous with a group selection signal to the bases of pnp bipolar transistor and npn bipolar transitors of the rth channel driver, wherein r represents an optional integr selected amoung 1, 2, 3 and 4, the pnp bipolar transistors are made non-conductive and npn bipolar transistors are made conductive during a period $\tau$ when signals are risen up and the pnp bipolar transistors are made conductive and npn bipolar transistors are made non-conductive for the other period. When the channel selection signals are risen up, an electrode 121 of the rth injection channel 121 in the group selected by corresponding to its term is made conductive to an earth wire and an electrode of a dummy channel 122 which acts as a counter electrode of the capacitators placed on both sides of the electrode 121 is made conductive to a positive electric source wire to charge the capacitators which are formed by two driving barriers 115 forming both sidewall surfaces of the injection channel such that the electric field is applied from its outside to its inside in the reverse directions with each other. As a result, a sharing force is produced toward the inside with respect to both sides barriers and the barriers are deformed toward the inside to compress an ink in the channel and spew an droplet from the injection hole 110 as shown in FIG. 4. After spending the term period $\tau$, since the electrode of the injection channels are made conductive to the positive electric source wire via the resistor of the channel driver and the dummy electrode is made conductive to the positive electric source wire, a loop of discharging is formed between the electrode of the injection channel and the electrode of the dummy channel to conduct a discharging depending on a time constant which is defined by the resistance and the capacity of the barriers and the voltage P of the electrode of the injection channel is gradually increased to the level corresponding to that of the positive electric source to be equivalent to the voltage of the electrode of the dummy channel. Accompanied therewith, the deformation of the barriers is gradually reduced and is returned to its original state.

When printing by using the printing head according to the above-described driving method, if the period T of the group selection signal is defined by $$T=p/v,$$

wherein v represents a shift rate of the printing head, the head moves to the extent of p in a period. And for printing dots continuously in a vertical direction, the head may be shifted to the extent of kp in an identical group, if the dot is printed from the (r+1)th injection hole after a lapse of k periods since printing from the rth injection hole and the two adjacent dots are stood in a vertical line. When the adjacent injection holes belong to the separated groups, a time interval for printings from the adjacent injection holes is represented by $$(s+1/n)T$$

wherein s represents an optional integer, since the driven phase difference between the adjacent groups amounts to (1/n)T after printing from the preceding injection hole in case of n time-sharing and, for the while, the printing head shifts to the extent of (s+1/n)p. Here, when selecting s as is represented by $$s=k+g$$

the shift distance of the printing head amounts to (k+g+1/n)p and corresponds to a horizontal component of these distances when the adjacent injection holes belong to the separated groups and the two adjacent dots stand in a vertical line. Thus, printing dots from the whole injection holes can be stood on the same vertical line and the distances in the vertical direction of these dots correspond to their vertical components of the injection holes to be p. The distances in the horizontal direction of the printing dots can be made p by performing the printing of the same injection holes with a time interval of the period T. Thus, the desired cross matrix graphic can be printed with the dots pitch p by successively driving the ink injection operations which corresponds to the each signals of the each with n time-sharing.

When the number of the injection holes in a group is represented by m, the number of the drivers is represented by (m+n), though the sum of the injection holes is represented by mn. In the present embodiment, n and m are presumed as $$n=4, \text{ and}$$

$$m=4$$

respectively and thus the number of drivers amounts to 8, while the sum of the injection holes amounts to 16. As a result, the number of drivers is reduced by half compared with the prior art in which it was required as much as the sum of injection holes.

Figure 13:
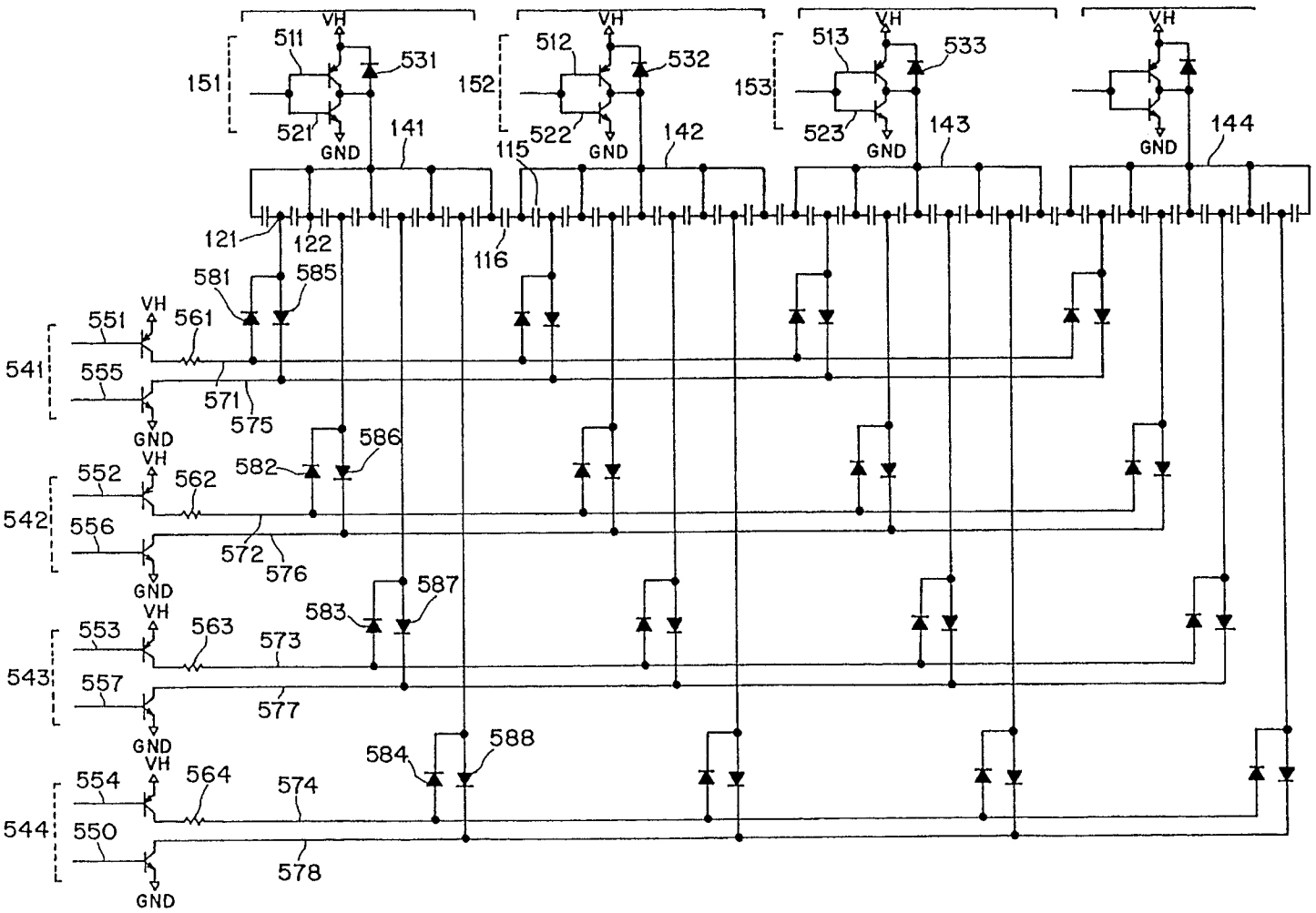
FIG. 13 is a block diagram illustrating an alternative driving method according to the first embodiment of present invention; and, FIG. 14 is a time chart illustrating an alternative driving method according to the first embodiment of the present invention.
Figure 14:
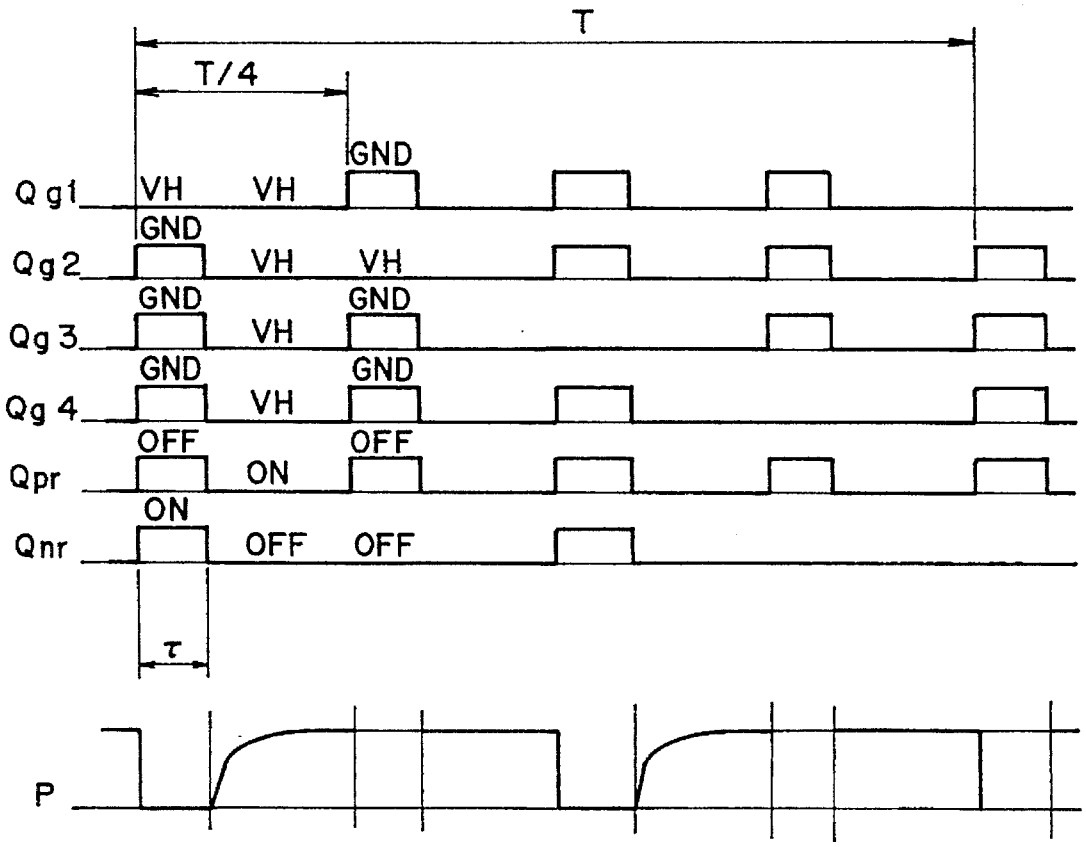

Referring to FIGS. 13 and 14, the alternative driving method of the printing head according to the first embodiment will be now explained. A plurality of dummy electrodes in a group are connected with each other to form common electrodes 141, 142 and 143, respectively and the common electrodes are connected to corresponding group drivers 151, 152 and 153. In the group drivers, pnp bipolar transistors 511, 512 and 513 and npn bipolar transistors 521, 522 and 523 are connected in series with the collectors and emitters of the pnp transistors are connected to a positive electric source and emitters of the npn transistors are connected to an earth wire of the electric source, respectively. Furthermore, to the pnp bipolar transistors, diodes 531, 532 and 533 are connected between their collectors and emitters by making their conductive directions reverse to each other to run an electric current in the reverse direction. The collectors of the pnp transistors and the npn transistors which are connected in series with each other are connected to the common electrodes of their corresponding groups such that they can be switched to the positive electric source or the earth and the bases are connected and are made to be driven by the common signal.

An electrode 121 which is the first electrode of the groups is connected to the first channel driver 541, an electrode of the second electrode thereof is connected to the second channel driver 542, an electrode of the third electrode thereof is connected to the third channel driver 543 and an electrode of the fourth electrode thereof is connected to the fourth channel driver 544, respectively. The channel drivers 541, 542, 543 and 544 each comprise a current-run-off circuit which is made by connecting the emitters of pnp bipolar transistors to the electric source and connecting the resistors 561, 562, 563 and 564 to the collectors of the pnp transistosin series and a current-attraction circuit which is made by connecting the emitters of npn bipolar transistors to the earth wire of the electric source. The lead wires 571, 572, 573 and 574 of the current-run-off circuit are connected to the driving electrodes via diodes 581, 582, 583 and 584 which are connected in the conductive direction with respect to the electrodes of the injection channels. The lead wires 575, 576, 577 and 578 of the current attraction circuit are connected to the driving electrodes via diodes 585, 586, 587 and 588 which are connected in the blocking direction with respect to the electrodes of the injection channels.

Referring to a time chart of FIG. 14, if is conducted a fourth time-sharing drive is conducted in which 4 groups of the first group to the fourth group are driven in this order, group selection signals Qg1, Qg2, Qg3 and Qg4 which are risen up with a pulse width of r and a period of (¼)T are applied to the bases of the first, the second, the third and the fourth group drivers as shown in FIG. 13, the pnp transistors are made non-conductive for a term of $\tau$ and the npn transistors are made conductive for this term $\tau$, but the pnp transistors are held conductive when the bases of the selected groups are applied and pnp transistors are given successive phase shifts of (¼)T without applying a pulse. By adding a channel-driving signal Qpr which is risen up with a pulse width of $\tau$ syncronous to the group selection signal to the bases of the pnp bipolar transistors of the rth channel driver, wherein r represents an optional integer selected among 1, 2, 3 and 4, the pnp bipolar transistors are made non-conductive for a period of $\tau$ when the signal is risen up and made conductive for the other term. On the other hand, to the base of the npn bipolar transistors, is added a channel-driving signal Qnr which is risen up with a pulse width of r syncronous to the group selection signal only when is present an ink injection signal and the npn bipolar transistors are made conductive for a term of $\tau$ when the signal is risen up and are made non-conductive for the other term.

In the term when the channel-driving signal is risen up and an ink injection signal is present, the electrode of the rth injection channel in the group selected corresponding to that term is made conductive to the earth wire and the electrode 122 of the dummy channel forming a counter electrode of the capacitators which are disposed on both sides of the electrode is made conductive to the positive electric source wire and charges the capacitators formed by the two driving barriers 115 which build up both wall surfaces of the injection channels in such a manner that an electric field is applied from the outside of the capacitators to the inside thereof in the reverse directions with each other. As a result, a shear force is produced toward the inside with respect to each barrier of both sides and the barriers are deformed in the inner directions to compress an ink in the channels and spew a droplet from the injection holes 110 as shown in FIG. 4. Subsequently, after passing the term τ, the electrode of the injection channel is made conductive to the positive electric wire via the resistor of the channel driver and, on the other hand, the dummy electrode is made conductive to the positive electric source wire via the diode of the group driver. For this reason, between the electrode of the injection channel and the electrode of the dummy electrode, is formed a loop of discharging and a discharging is conducted with a time constant determined by the resistor and the capacity of the barrier and thus the voltage P of the electrode of the injection channel is gradually increased from the level of the earth to the level of the positive electric source and is made equivalent to the voltage of the electrode of the dummy source. Accompanied therewith, the deformation of the barrier is gradually decreased and is returned to its original state. When is absent an ink injection signal is absent, a charging current is not run to the capacitors which form both barriers of the pnp and npn transistors and the voltage of the electrodes of injection channels are maintained the level of the positive electric source since they are made non-conductive.

When the group is not selected, the voltages are made equivalent and a charging current does not run even though the common electrode are made conductive to the earth wire and the npn transistors of the channel driver are made conductive in the term τ. Loop currents between adjacent groups don't run, because they are blocked with each other by the diodes connected to the electrodes.

Figure 7:
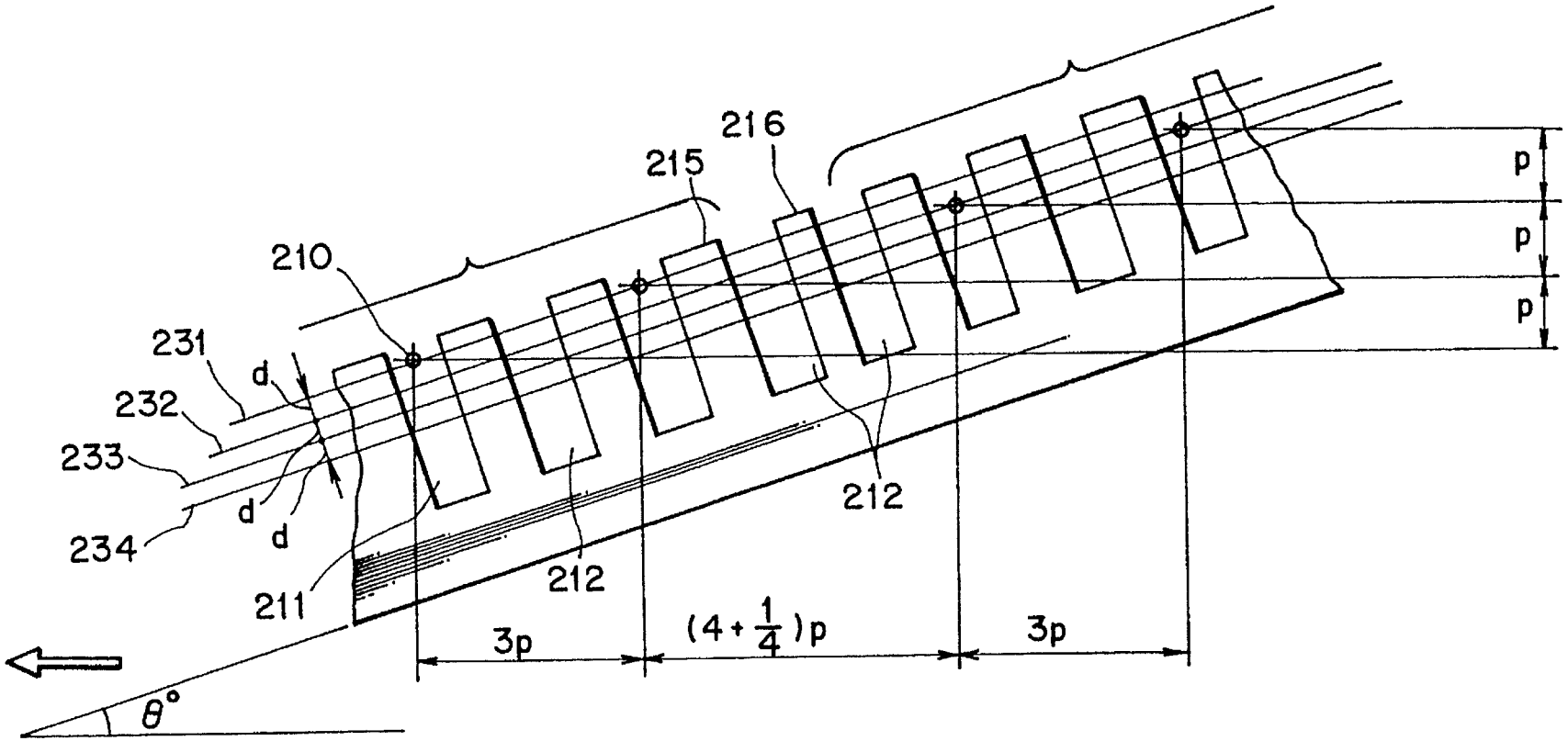
FIG. 7 is a side view illustrating an arrangement of injection holes according to the second embodiment of the present invention.

The second embodiment of the present invention will be now described with reference to FIG. 7. This embodiment is similar to the first embodiment except that the arranged direction of channels corresponds to the center lines of injection holes. The arrangement of an injection channel 211, a dummy channel 212, a driving barrier 215 and a separating barrier 216 is similar to that of the first embodiment. The driving method in this embodiment is similar to that of the first embodiment. For this reason, only a point of difference from the first embodiment will be explained. In FIG. 7, the arranged direction of channels is inclined angle θ° with respect to the horizontal direction of printing, the injection holes 210 are arranged in such a manner that the arranged center lines 231, 232, 233 and 234 of the injection holes in a group are inclined angle θ° with respect to the horizontal direction of printing dots and, between the adjacent groups, the center line of the preceding group is parallelly translated into a length represented by (g+1/n)p to the direction reverse to the translated direction of the head by using an integer g and is made to a center line of the arrangement of the succeeding injection holes. In such an arrangement, the distance of these center lines between the adjacent groups which corresponds to the distance in the vertical direction to the center line is presumed d, it is defined by $$d=(g+1/n)p\sin\theta°$$

and the value of d decreases as the decrease of the values of θ and g.

In the present embodiment, the values of n, g, k and sinθ° are selected as follows;

$$n=4$$

$$g=1$$

$$k=3, \text{ and}$$

$$\sin\theta°=0.27$$

and d is represented by $$d=0.33p.$$

Thus, if the depth of the channel may be some greater than the dot pitch p, the situation of the injection holes with respect to the channels does not project from the bottom of the channel though they are step by step fallen down and the arrangement of the fourth group is made possible. In the present embodiment, the depth of the channels is taken up so as t be 2p or more and thus the injection holes can be arranged with sufficient allowance. If the printing head of the present embodiment is driven by the driving method described in the first embodiment, regular interval dot matrix printing can be performed in a time-sharing way based on the same principle with that of the first embodiment. If the printing head of the present invention is driven by means of the driving method described in the first embodiment, a driving circuit can be simplified.

Figure 8A:
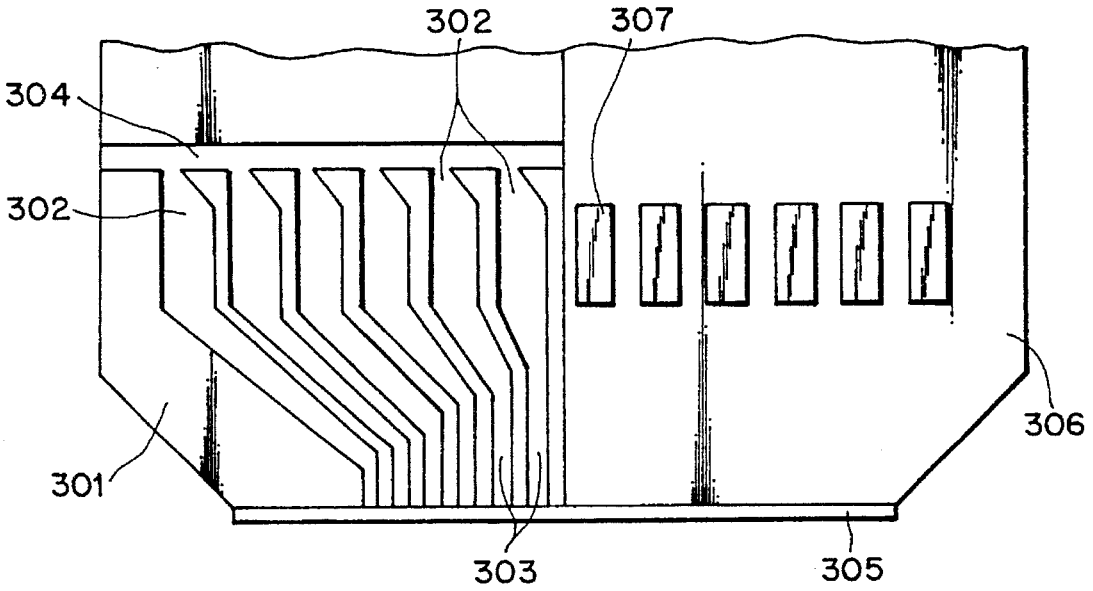
FIG. 8(*a*) is a front view illustrating a structure according to the third embodiment of the present invention.
Figure 8B:
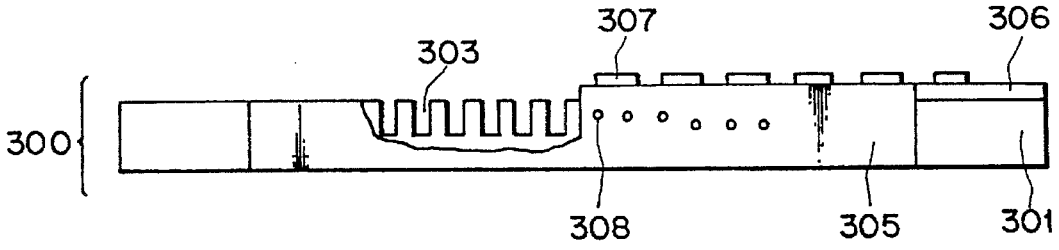
Figure 9:
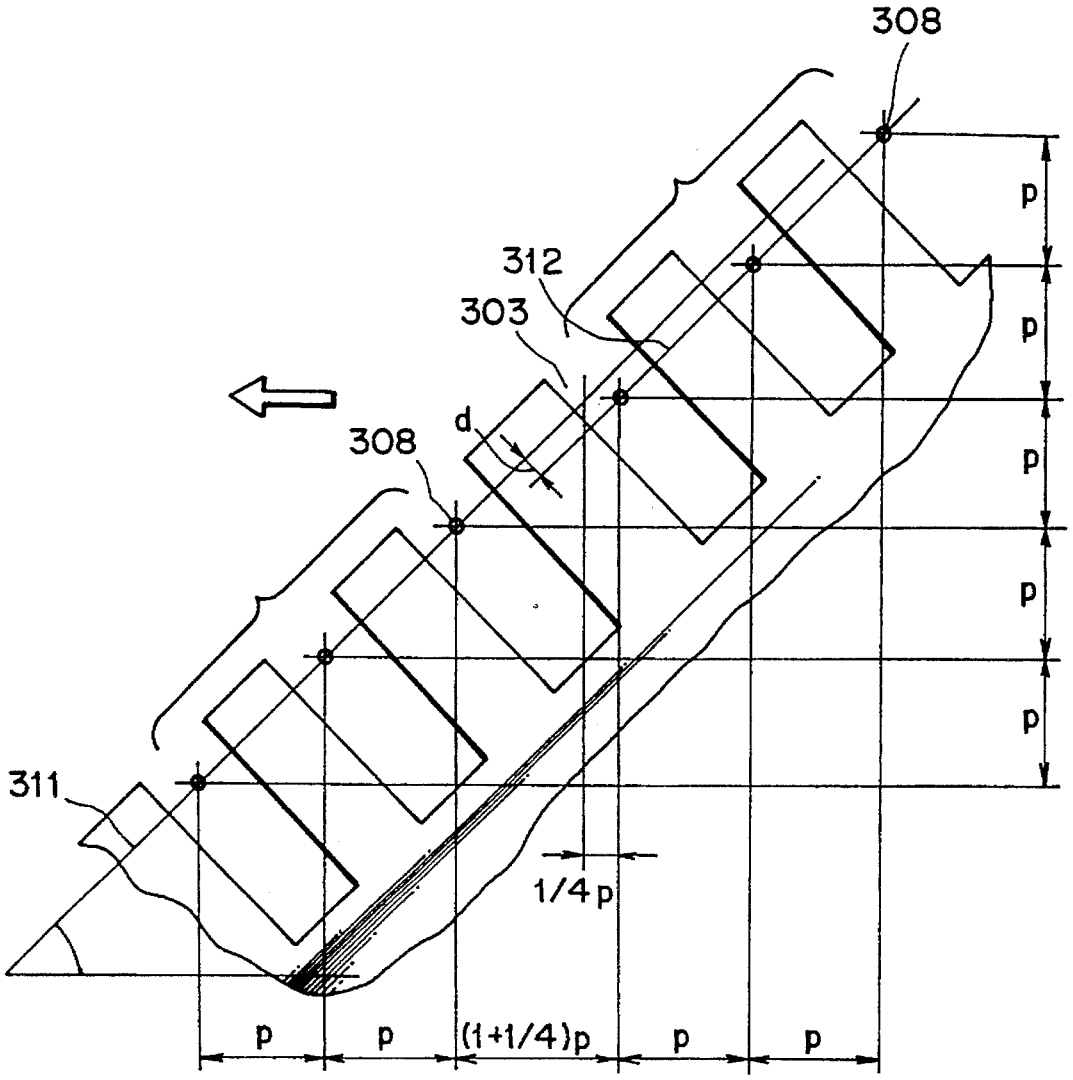
FIG. 9 is a side view illustrating an arrangement of injection holes according to the third embodiment of the present invention.
Figure 10A:
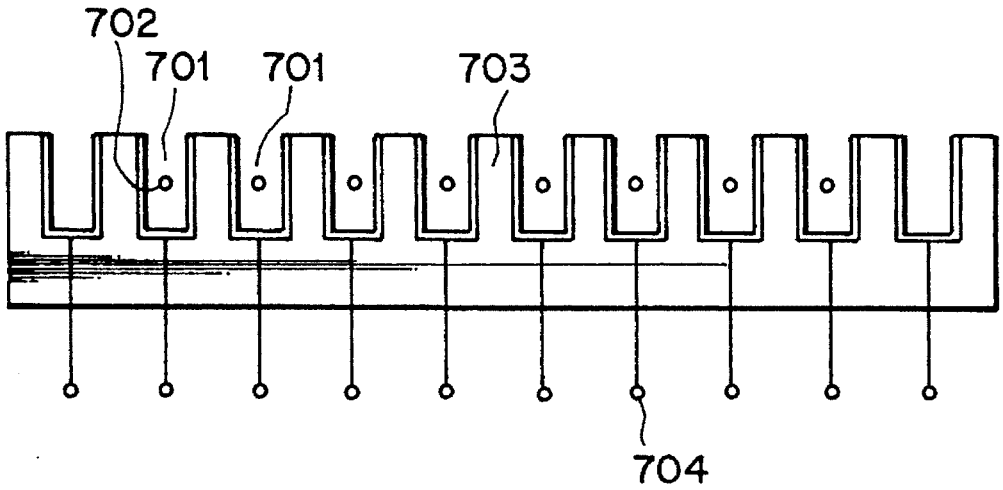
FIG. 10(a) PRIOR ART
FIG. 10(*a*) is a side view illustrating a structure of the prior art.
Figure 10B:
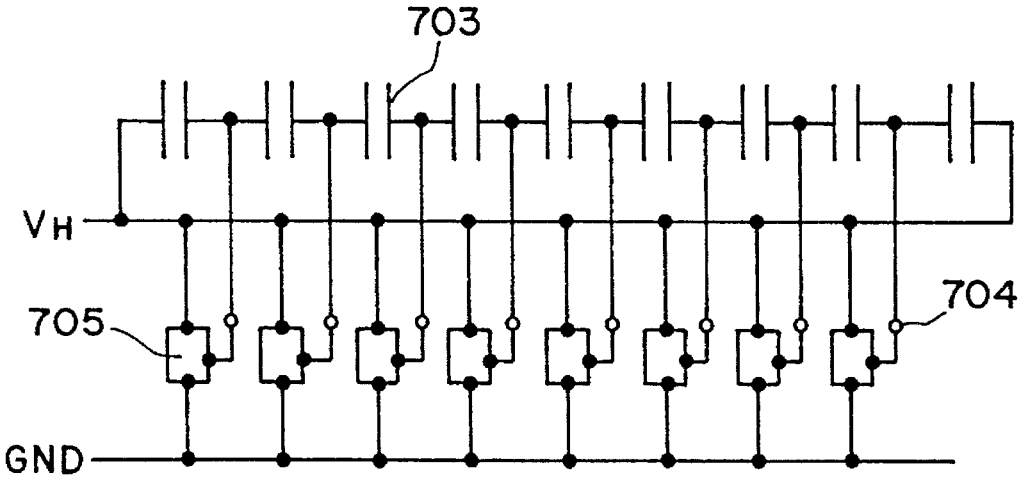
FIG. 10(b) PRIOR ART
Figure 11A:
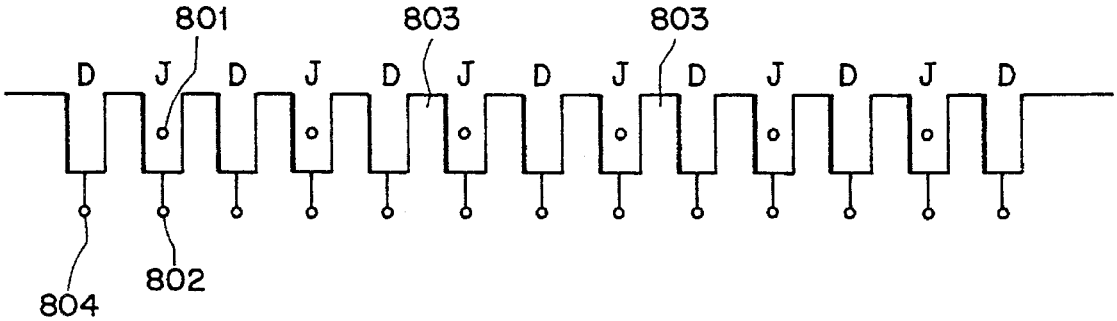
FIG. 11(a) PRIOR ART
FIG. 11(*a*) is a model view illustrating a structure of the prior art.
Figure 11B:
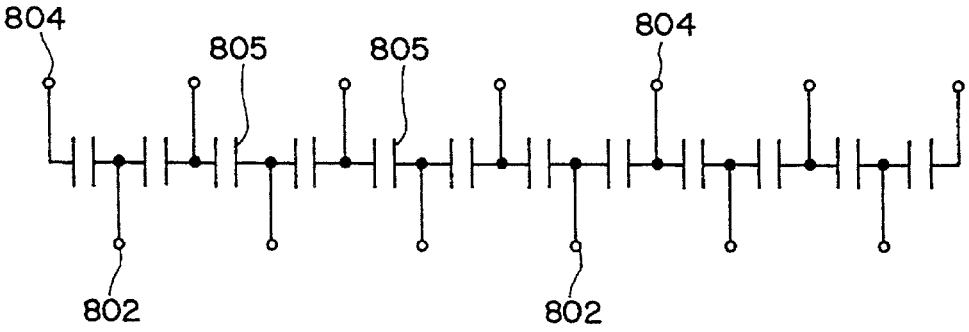
FIG. 11(b) PRIOR ART
Figure 12:
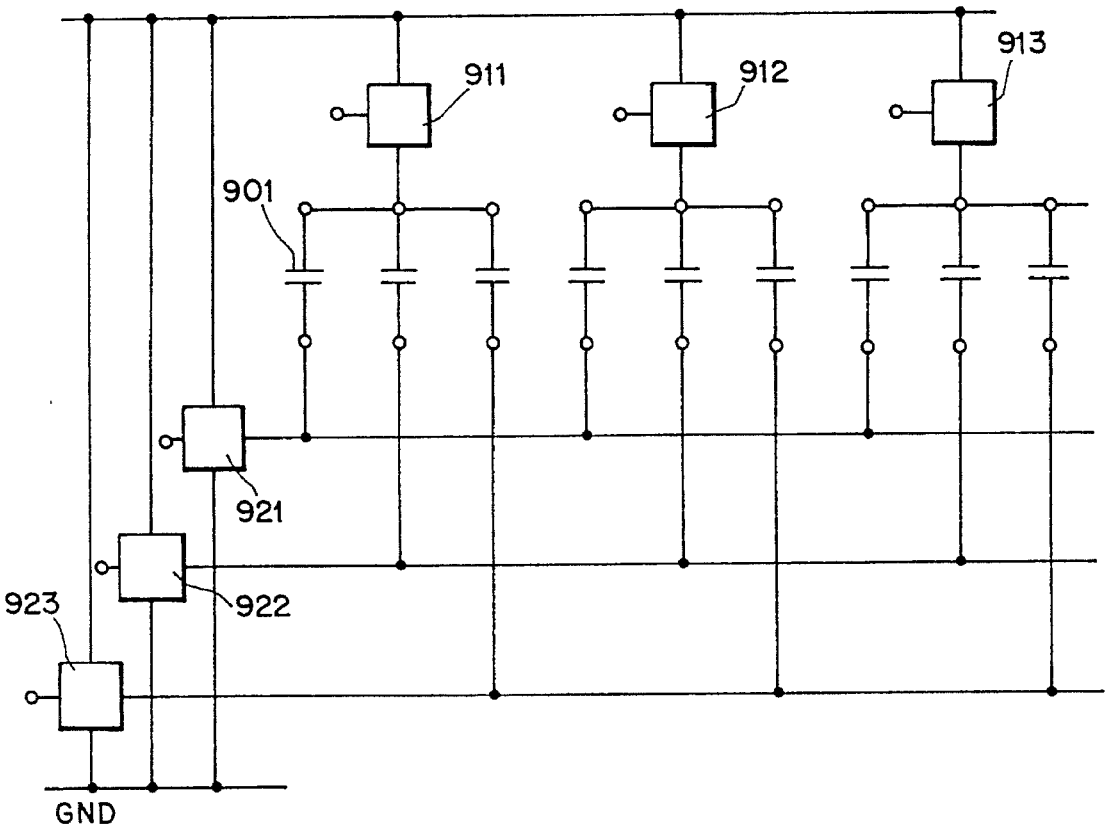
FIG. 12 PRIOR ART
FIG. 12 is a block diagram illustrating a driving circuit of the prior art.

Subsequently, the third embodiment of the present invention will be explained with reference to FIGS. 8(A), 8(*b*), 9 and 12. This third embodiment is an example of the present invention in a printing head in a mode of deforming a cover of a pressure chamber in which an ink is charged by using flexibility caused by a bent mode of a piezoelectric element. In FIGS. 8(*a*) and 8(*b*), there are provided on a substrate 301 the first channel 302 which forms a pressure chamber, the second channel 303 which forms injection channel and the third channel 304 from which an ink is introduced. The second channel 303 is lined up and opened on one end surface of the substrate. On the end surface, a nozzle plate 305 is mounted and an injection hole 308 is provided on the nozzle plate corresponding to the injection channel 303. On the upper surface of the substrate, a tin plate 306 is mounted and, on the upper surface of the tin plate, piezoelectric elements 307 are respectively mounted corresponding to the first channel to form a head 300. An equivalent circuit of the piezoelectric element is made to a parallel circuit of the capacitators as shown in FIG. 12 and is shared with m pieces to be n groups and n time-shared and driven to reduce a volume of the pressure chamber by driving a piezoelectric element, spew an ink droplet from the injection hole and perform a dot printing. In FIG. 9, the injection holes 308 are arranged in such a manner that, in a group, the center lines 311 and 312 of the arrangement of the injection holes are inclined angle θ° with respect to the horizontal direction of the printing dots so that the vertical component of the distance between the adjacent injection holes Mounts to p and the horizontal component thereof Mounts to kp which is a whole number of k and, between the adjacent groups, the center line of the injection hole arrangement of the preceding group is parallelly translated with a length represented by (g+1/n)p by using an integer g toward the direction reverse to the proceding direction of the printing head to be an arranged center line of the injection holes of the succeeding group and, on the arranged center line, the first injection hole of the succeeding group is arranged at the position where the distance between the last injection hole of the preceding group and the first injection hole of the succeeding hole is represented by p. The arranged direction of the injection channels is inclined angle θ° with respect to the horizontal direction of printing.

In the present embodiment, the values of n, m, g and k are selected as follows;

$$n=4,\ m=3,\ g=0 \text{ and } k=1$$

If the distance of these center lines between the adjacent groups which corresponds to the distance in a vertical direction of the center line is presumed to be d, $$d=(g+1/n)p\sin\theta°=(1/4)p\sin 45=0.17p.$$

Furthermore, if the horizontal component of the distance between adjacent groups is presumed to be defined as D, $$D=(g+1/n+k)p=1.25p.$$

ps If the period of the group selection signals in a time-sharing drive is defined as T and the phases of these signals are presumed to successively shift to the extent of (1/4)T between the adjacent groups and the shift rate v of the head is presumed to be $$v=p/T,$$

printing from the subsequent injection hole is made possible in the same group, when the time T is lapsed since the printing of the preceding injection hole and head is shifted with the distance p and the injection from the subsequent injection hole is made possible, when the time 1.25T is lapsed and the head is shifted with the distance 1.25p between the adjacent groups. For this reason, the printing dots from the whole injection holes can be stood on the same vertical line. In this case, the whole dot distances can be uniformly made to the distance p, because the whole vertical component of the distance between the each adjacent injection holes is ensured to be the distance p. And further, in the present embodiment, the number of drivers is reduced from 12 pieces to 7 pieces by using a time-sharing drive.

It will be apparent that the present invention, as described above, makes it possible to perform a time-sharing drive of a piezoelectric ink jet head by using a shearing force and thus contributes to the decrease in cost and miniaturizing of a printer system by simplifying the driving circuit thereof and it can compensate an ununiformity of the distances of the adjacent injection channels and a shear in printing time which are caused by time-sharing of the ink channels of the printing heat by means of an arrangement structure of the injection holes to make it possible to perform the printing of dot matrix with a completely similar pitch by using a time-sharing drive and, when time-sharingly driving an ink jet head different from the printing head of a piezoelectric ink jet printer using the shearing force mode, the arrangement structure of the injection holes of the present invention compensates a share of printing timing between the adjacent groups to make it possible to perform the printing of dot matrix with a completely similar pitch and settle the common problems such as pitch irregularity of the printing dot described in Japanese Laid-Open Patent Publication No. 263760/1986.

The invention may be embodied in other specific forms without departing from the spirit or essential characteristics thereof. The above described embodiment are therefore to be considered in all respects as illustrative and not restrictive, the scope of the invention being indicated by the appended claim rather than by the foregoing description and all changes which come within the meaning and range of equivalency of the claims are therfore intended to be embraced therein.

What is claimed is:

1. An ink jet head of a printer, said ink jet head comprising:

a plurality of pressure chambers juxtaposed and aligned in a first direction on a substrate, said plurality of pressure chambers defined by a plurality of piezoelectric deformable channels juxtaposed and aligned in said first direction and a nozzle plate covering an opening of each of said plurality of piezoelectric deformable channels, said nozzle plate having a plurality of ejection holes formed therein;

a supply channel which supplies ink to said plurality of piezoelectric deformable channels; and, electrodes coupled to said plurality of piezoelectric deformable channels, said electrodes for selectively applying drive voltages to said plurality of piezoelectric deformable channels to selectively deform said plurality of piezoelectric deformable channels so as to selectively alter a volume of said plurality of pressure chambers;

wherein said plurality of pressure chambers are separated into n groups, where n is an integer greater than 1, each of said groups being formed by a plurality of ejection pressure chambers which eject ink through a corresponding ejection hole in said nozzle plate and a plurality of dummy pressure chambers which do not eject ink, said ejection pressure chambers and said dummy pressure chambers alternately arranged in each of said n groups such that a dummy pressure chamber is interposed between adjacent ejection pressure chambers within each of said n groups and such that a dummy pressure chamber is located at each opposite end of each of said n groups;

wherein a separating barrier is located between each said dummy pressure chamber located at the opposite ends of each adjacent pair of said n groups;

wherein said electrodes include a plurality of common electrodes respectively coupled to the piezoelectric deformable channels of the dummy pressure chambers of each of said n groups;

wherein, within each of said n groups, the ejection holes of said nozzle plate are aligned in a second direction which extends at an angle θ relative to a horizontal print direction of said printer, where $0<\theta<90°$;

wherein a spacing between adjacent ejection holes of said nozzle plate, along an entirety of said n groups, relative to a vertical print direction of said printer is a constant distance p, wherein a spacing between adjacent ejection holes of said nozzle plate, within each of said n groups, relative to the horizontal print direction of said printer is kp, where k is a constant; and wherein adjacent pairs of ejection holes located at the opposite ends of adjacent pairs of said n groups are spaced apart relative to the horizontal print direction of said printer by a distance kp+(g+1/n), where g is an integer.

2. An ink jet head according to claim 1, wherein said first direction extends at an angle Φ relative to the horizontal print direction, where $0<\Phi<\theta$.

3. An ink jet heat according to claim 1, further comprising drive means for driving said n groups on a timeshare basis.

4. An ink jet heat according to claim 2, further comprising drive means for driving said n groups on a timeshare basis.

5. An ink jet head of a printer, the ink jet head having a plurality of pressure chambers juxtaposed and aligned in a first direction, the improvement comprising:

said plurality of pressure chambers separated into n groups, where n is an integer greater than 1, each of said groups being formed by a plurality ejection pressure chambers which eject ink through a corresponding ejection hole and a plurality of dummy pressure chambers which do not eject ink, said ejection pressure chambers and said dummy pressure chambers alternately arranged in each of said n groups such that a dummy pressure chamber is interposed between adjacent ejection pressure chambers within each of said n groups and such that a dummy pressure chamber is located at each opposite end of each of said n groups;

a separating barrier located between each said dummy pressure chamber located at opposite ends of each adjacent pair of said n groups;

a plurality of common electrodes respectively coupled to the dummy pressure chambers of each of said n groups;

wherein, within each of said n groups, the ejection holes are aligned in a second direction which extends at an angle $\theta$ relative to a horizontal print direction of said printer, where $0<\theta<90°$;

wherein a spacing between adjacent ejection holes, along an entirety of said n groups, relative to a vertical print direction of said printer is a constant distance p, wherein a spacing between adjacent ejection holes, within each of said n groups, relative to the horizontal print direction of said printer is kp, where k is a constant; and wherein adjacent pairs of ejection holes located at the opposite ends of adjacent pairs of said n groups are spaced apart relative to said horizontal print direction by a distance $kp+(g+1/n)$, where g is an integer.

6. An ink jet head according to claim 5, wherein said first direction extends at an angle $\Phi$ relative to the horizontal print direction, where $0<\Phi<\theta$.

* * * * *